US005704782A

United States Patent [19]

Schulze et al.

[11] Patent Number: 5,704,782

[45] Date of Patent: Jan. 6, 1998

[54] WEAR LINING FOR A ROTARY FURNACE

[75] Inventors: Joachim Otto Schulze, Nieuwerkerk a/d Ijssel; Johannes Adrianus Maria Butter, Gouda, both of Netherlands

[73] Assignee: N.V. Gouda Vuurvast, Gouda, Netherlands

[21] Appl. No.: 640,817

[22] PCT Filed: Nov. 17, 1994

[86] PCT No.: PCT/NL94/00291

§ 371 Date: May 8, 1996

§ 102(e) Date: May 8, 1996

[87] PCT Pub. No.: WO95/14202

PCT Pub. Date: May 26, 1995

[30] Foreign Application Priority Data

Nov. 17, 1993 [NL] Netherlands ..... 9301989

[51] Int. Cl.[6] ..... F27B 7/28; F27B 7/14

[52] U.S. Cl. ..... 432/119; 432/103; 432/105

[58] Field of Search ..... 432/103, 105, 432/110, 111, 118, 119

[56] References Cited

U.S. PATENT DOCUMENTS

| | | | |
|---|---|---|---|
| 2,180,969 | 11/1939 | Seil . | |
| 3,343,319 | 9/1967 | Reintjes | 432/119 |
| 3,343,824 | 9/1967 | Schneider | 432/119 |
| 3,346,248 | 10/1967 | Martinet et al. | 432/119 |
| 3,362,698 | 1/1968 | Cerny et al. | 432/119 |
| 3,380,211 | 4/1968 | Snellman | 432/119 |
| 3,593,476 | 7/1971 | Hodl | 52/249 |

FOREIGN PATENT DOCUMENTS

| | | |
|---|---|---|
| 0 103 365 | 3/1984 | European Pat. Off. . |
| 2 092 443 | 1/1972 | France . |
| 2 515 800 | 5/1983 | France . |
| 1 583 466 | 8/1970 | Germany . |
| 2 056 681 | 5/1972 | Germany . |

*Primary Examiner*—Henry A. Bennett
*Assistant Examiner*—Gregory Wilson
*Attorney, Agent, or Firm*—Young & Thompson

[57] ABSTRACT

A wear lining for a rotary furnace of an incineration installation for, for example, chemical waste, wherein the wear lining comprises tapered bricks (1, 2, 3) which are installed in the furnace in the form of a vaulted lining, the main taper of each brick being matched to the desired vaulted lining shape, and wherein the height (H) of the bricks extends in the thickness direction of the lining. In this lining the bricks are of low porosity and able to withstand high temperatures and chemicals. Furthermore, the bricks have an additional taper which extends at least over part (h) of the height thereof, which additional taper provides, on the inside (9) of the lining, an increase in the gap width (T1) between adjoining bricks which decreases towards the outside of the lining. Preferably, the additional taper is such that, in the cold assembled state, the increase in the gap width (T1) on the inside of the lining is in the range from 1 mm to 2.4 mm. The additional taper extends over 0.1 to 0.6 times the height of the brick. The additional taper can amount to 0.15 to 0.6 times the main taper. A circumferential taper can be 0.75 to 1 degree.

11 Claims, 1 Drawing Sheet

WEAR LINING FOR A ROTARY FURNACE

This Appln is a 371 of PCT/NL94/00291 filed Nov. 17, 1994 to first sentence of specification.

FIELD OF THE INVENTION

The present invention relates to a wear lining for a rotary furnace of an incineration installation for chemical waste, wherein the wear lining comprises tapered bricks which are installed in the furnace in the form of a vaulted lining, the main taper of each brick being matched to the desired vaulted lining shape, and wherein the height of the bricks extends in the thickness direction of the lining, in which the bricks have an additional taper which extends at least over part of the height thereof, which additional taper provides, on the inside of the lining, an increase in the gap width between adjoining bricks which decreases towards the outside of the lining.

BACKGROUND OF THE INVENTION

As a consequence of the very rapid growth in the chemical industry, both in respect of the quantities produced and in respect of the variety in the types of products, the treatment of chemical waste has grown to be an appreciable problem for society. In order to provide a solution to this problem, amongst other things incineration installations for chemical waste have been developed.

In the context of the present invention, "chemical waste" is defined both as material in solid form and as material in liquid or paste-like form, or mixtures of solid and/or liquid and/or paste-like materials.

Inclined rotary furnaces are frequently used for the incineration of, in particular, chemical waste. With these installations, the chemical waste is fed to an inclined rotary furnace at the high end, after which it is exposed to a temperature of between 850° C. and 1350° C. in the rotary furnace. The rotary furnace issues into a post-combustion furnace, in which a temperature of between 850° C. and 1300° C. prevails. The resulting gas, solid and/or liquid mixture is then subjected to a number of treatments known from the prior art, such as, inter alia, separation, cooling and washing. In this context, the process conditions and dimensions of the installation are dependent of the nature of the waste, on the desired capacity and on requirements laid down by governmental authorities.

The wear lining of the rotary furnaces is subjected to severe stresses in incineration installations of this type. As a result of the high operating temperatures, the material of the lining expands and high internal material stresses arise on the inside of the lining as a consequence of compressive forces. As a consequence of these high internal stresses, the bricks from which the lining is made have a tendency to crack and/or splinter. This cracking and/or splintering is, furthermore, also appreciably promoted because the load in the furnace is chemically highly aggressive and of differing composition. Moreover, the rotating furnace is subjected to severely fluctuating thermal and mechanical stresses, which vary according to time and location, and this has a further adverse effect on the life of the wear lining.

In conventional rotary furnaces, the diameter varies between 2.5 and 5 meters, whilst the length can be 10 to 15 meters. The furnace is frequently provided with two race rings and a drive ring, which also serve as reinforcing rings. As a consequence thereof, the steel jacket of the furnace can undergo thermal deformation to differing extents in different locations under the influence of the effect of temperature and can also be subjected to fluctuating mechanical stresses during rotation with the moving load.

As a consequence of the severe attack on the wear lining under the influence of all of these factors, the wear lining has to be replaced regularly, which gives rise to high costs and also reduces the availability of the furnace.

In order to prolong the life of the wear lining it is known to insert a felt-like layer between the wear lining and the steel jacket of the furnace. This felt-like layer is able to absorb the expansion of the wear lining caused by the high operating temperatures and thus is able to effect a reduction in the internal material stresses in the wear lining. However, said felt-like layer has the disadvantage that it also functions as insulation, as a result of which there is poorer encrusting of slag on the bricks of the wear lining. Moreover, the pressure distribution on the inside of the lining is still unfavourable as a result of the occurrence of point loads, which have an adverse effect on the life of the wear lining.

EP 0 103 365 discloses a rotary furnace for cement, in which the bricks of the lining are made of periclase. One side face of these bricks is provided with an extra taper on the hot side. An extra taper of this type gives rise to stability problems when the bricks arc installed, as a result of which the additional gap width can be lost. In order to overcome these problems, EP 0 103 365 proposes the formation of additional protrusions on the bricks, in order to provide stability thereto during the installation thereof. In order to provide an expansion gap, said protrusions must disintegrate on heating the furnace, in connection with which the total surface area of the protrusions must not be too large. It is not stated how said protrusions disintegrate. In view of the brittleness of periclase, the protrusions will probably powder. Another possibility is that they break off or splinter. Probably peeling will also occur at the adjoining brick at the location of the contact with the protrusion of an adjoining brick. As a consequence of the disintegration of the protrusions, the additional tapered side face section will show damage, which renders the wear lining susceptible to the action of chemicals. Damage to the adjoining brick at the location of the contact with a protrusion further increases the sensitivity to the action of chemicals. A further point is that bricks made of periclase are completely unsuitable for a chemical incineration installation. After all, periclase is susceptible to attack by slag, which is highly undesirable in chemical incineration installations. A further disadvantage of periclase is its high coefficient of thermal expansion, which leads to high internal stresses and thus increases the risk of splintering. Therefore the bricks of EP-0,103,365 are unsuitable for use in a rotary furnace for the incineration of chemical waste.

DE 2 056 681 describes a brick made of porous refractory material for a gas furnace. Said bricks are not used in the form of a vaulted wear lining and are intended for supplying the furnace with gas via the bricks. The bevels must provide an expansion gap in order to prevent the porosity of the bricks being reduced as a consequence of expansion due to thermal expansion. The bricks from DE 2 056 681 are ordinary block-shaped bricks with a bevel, which do not give rise to any stability problems.

SUMMARY OF THE INVENTION

The present invention has as its object to provide an improved wear lining for a rotary furnace of an incineration installation for chemical waste, which wear lining is easy to install, in which stress peaks on the inside of the wear lining are reduced, and in which the wear lining has an improved resistance to chemicals.

According to the present invention this aim is achieved by a wear lining according to the claims.

By providing the bricks with an additional taper in addition to the main taper, which provides the wedge shape of the bricks required for the vaulted lining shape, it is possible to increase the gap width between adjoining bricks on the inside of the wear lining. Said additional gap width can be filled with mortar, which has less structure and is softer than the bricks. Said mortar can absorb the expansion of the bricks as a consequence of the high operating temperatures, as a result of which the stress peaks on the inside of the wear lining are reduced, which renders the wear lining less susceptible to the action of chemicals. The mortar provides stability during installation of the wear lining in the furnace which facilitates the installing of the lining, and when the furnace is fired up, the mortar is compressed to form a compact mass, which improves the resistance of the mortar to chemicals. At the same time, it is possible to omit the felt-like layer which in the prior an is intended to absorb the expansion of the wear lining, so that adverse insulation is no longer provided by said felt-like layer.

The bricks used are preferably of low porosity and are able to withstand high temperatures, that is to say up to 2000° to 2100° C. In the case of the incineration of chemical waste, the bricks must also be able to withstand diverse chemicals. The porosity of the bricks is less than 18%, porosities of 10 to 11% or less being highly advantageous (in this context the porosity represents the percentage of open, non-enclosed cavities). In the case of chemical incineration, the temperature which arises will usually be below 1500° C. In general, the bricks must be able to withstand temperatures of 700° to 2100° C.

The additional taper can be an additional axial taper and/or a circumferential taper. In this context, an axial taper relates to the faces of adjoining bricks which form a join extending in the axial direction, that is to say which form a gap extending in the axial direction on the inside of the wear lining. A circumferential taper in this context relates to the faces of adjoining bricks which form a join extending in the circumferential direction of the wear lining, that is to say open into a gap which extends in the circumferential direction on the inside of the wear lining. The main taper, which is needed for the vaulted lining shape, is thus an axial taper and the additional taper to be added thereto according to the invention is indicated as additional axial taper. The additional taper of the joins running in the circumferential direction is indicated as circumferential taper, since these joins normally show no taper in the case of a cylindrical rotary furnace, and the additional taper here is therefore the only taper. The tapers can be expressed as a ratio or as an angle. The additional taper can also be related to the main taper.

In particular, good results arc obtained according to the invention if the additional taper is such that, in the cold assembled state, the increase in the gap width on the inside of the lining is in the range from 1 mm to 2.4 mm, preferably in the range from 1.2 to 2.0 mm. The stress peaks of the internal material stresses on the inside of the wear lining are appreciably decreased with this arrangement, whilst when the furnace is fired up, the mortar is compressed to form a compact whole which has good resistance to chemicals.

Furthermore, according to the invention it is advantageous if the additional taper extends over 0.1 to 0.6 times, preferably 0.25 to 0.55 times, the height of the brick. With an additional taper of this type, the location where the maximum compressive stresses occur is shifted sufficiently far away from the inside of the lining towards the outside thereof, towards the interior of the brick, so that splintering of the brick and the action of chemicals are appreciably reduced, whilst adjoining bricks remain sufficiently firmly positioned with respect to one another.

In connection with the expansion of the bricks, which are installed in a vaulted shape, under the influence of the heat prevailing under operating conditions, it has proved advantageous, according to the invention, for the additional taper to be 0.15 to 0.6 times, preferably 0.2 to 0.5 times, the main taper. That is to say, if the main taper is 10°, the additional taper can be, for example, 0.3×10=3°. With an additional taper of this type, the mortar can, on heating up, be compacted to form a compact mass which has very good resistance to chemicals.

Furthermore, according to the invention it has proved advantageous if the bricks of the wear lining not only have an additional axial taper but also have a circumferential taper. A circumferential taper of 0.75 to 1 degree is found to be well able to absorb stresses as a consequence of the expansion of the bricks in the axial direction, so that an irregular stress distribution in the axial direction is also counteracted.

According to the invention, bricks of the type having a high corundum content are very suitable, said type preferably containing at least 70% of aluminium oxide, and also oxides of one or more of the following elements: silicon, titanium, zirconium, sodium, chromium, magnesium and phosphorus. Bricks of this type which have a high corundum content have low porosity and can be laid with the aid of mortar without any great stability problems, the mortar being compressed when the furnace is heated, so that the porosity thereof is reduced and the resistance to chemicals is thus increased.

It has proved advantageous that an appropriate choice of the height/width ratio and/or length/height ratio can also make a favourable contribution to prolonging the life of the wear lining. The height/width ratio is preferably in the range from 1 to 3.5, whilst very good results are achieved with a ratio of 1.5 to 3. The length/height ratio of a brick is preferably in the range from 0.45 to 1.3, whilst very good results are achieved with a ratio of 0.5 to 0.95.

It is obvious to provide the additional gap width on the inside of the wear lining by providing both adjoining faces of adjoining bricks with an additional taper. However, it is less expensive to provide only one adjoining face of two adjoining bricks with an additional taper of this type. It is obvious that said taper must then be greater in order to achieve the same increase in the gap width.

Especially when the bricks are of asymmetric shape as described above, it is extremely important that they are positioned correctly with respect to one another when the wear lining is laid. Mistakes and instability during laying can be prevented by allowing the adjoining faces of adjoining bricks to engage in one another by means of a tongue and groove system. A tongue and groove system of this type is preferably arranged in the vicinity of the outside of the wear lining, in order to avoid interference with the additional gap width. A further advantage of this tongue and groove design is that the bricks can be laid at a greater speed and that the brickwork has a greater stability during and after laying.

The present invention also relates to a brick which is suitable for the wear lining according to the invention, as well as to a rotary furnace provided with a wear lining according to the invention, and in particular to an incineration installation for chemical waste which is provided with a rotary furnace provided with a wear lining according to the invention. The rotary furnace according to the invention is in particular of the type where the rotary furnace, which is preferably arranged sloping downwards, opens into a post-combustion chamber.

The invention also relates to a method for the incineration of chemical waste, with which method use is made of a wear lining according to the invention or a rotary furnace with a wear lining according to the invention.

The invention also relates to the use of a wear lining according to the invention in the incineration of chemical waste.

BRIEF DESCRIPTION OF DRAWINGS

The invention will be explained below with reference to the drawing. In the drawing.

DETAILED DESCRIPTION

Figure 1:
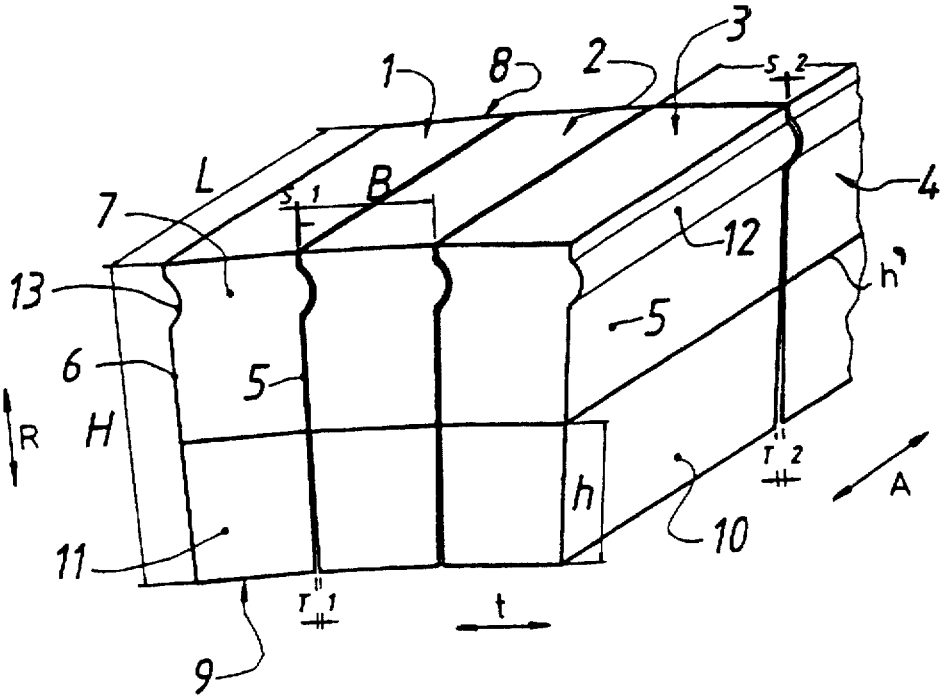
FIG. 1 shows a part of the wear lining.

FIG. 1 shows three bricks having reference numerals 1, 2 and 3, the bricks 1, 2 and 3 making up part of a ring of similar bricks. Several such rings fitted one after the other tin the axial direction A form the wear lining installed in the form of a vaulted lining in the rotary furnace. The rotary furnace itself is of a construction known per se, so that further details thereof are not shown in the drawing since these are not of importance for understanding the invention.

Reference numeral 4 indicates part of a brick which forms part of a second ring of bricks behind the ring to which the bricks 1, 2 and 3 belong.

The dimensions of the bricks in, respectively, the radial direction R, the circumferential direction (or ring direction) t and the axial direction A are indicated by the letters H (height), B (width) and L (length). The bricks 1, 2 and 3 each have a main taper on either side, as a result of which the side faces 5 and 6 thereof are positioned at a small angle with respect to one another. Said main taper will be dependent on the degree of vaulting of the wear lining. The bricks therefore have a wedge shape, as a result of which, on assembly, a ring is formed which fits inside the jacket of the rotary furnace.

The wear lining is installed in the furnace by laying the bricks with a thin layer of refractory mortar to produce an inner lining forming the wear lining. The thickness of the mortar layer can vary from one to a few millimeters. The joint thickness is indicated by S1.

In the case of a cylindrical rotary furnace, the end faces 7 and 8 are parallel to one another, as a result of which, for example, bricks 3 and 4 can be laid in a straight line one after the other. A layer of mortar S2 is arranged here as well, which layer is essentially of the same thickness as the layer of mortar S1.

Part 10 of side face 5 runs at a small inwards angle with respect to the remainder of side face 5 over a height h, measured from the inside 9 (or fire side 9) of the wear lining. By this means an additional taper, in this case a so-called additional axial taper, is provided on the bricks. Side face 6 is provided with an additional axial taper in a corresponding manner. As a result of said additional axial tapers on either side of each brick, the gap width of the gaps running in the axial direction between adjoining bricks on the inside of the wear lining is increased. Said additional gap width decreases from the inside of the wear lining towards the outside and is 0 (zero) at height h', so that from h' to the outside the gap width has a constant value S1.

In a corresponding manner, the parts 11 of the front and rear faces 7 and 8 are positioned at an inwards angle. The bricks consequently are provided with a further additional taper, the so-called circumferential taper, that is to say the gap width of the gaps running in the circumferential direction between adjoining bricks is increased on the inside of the lining. As a consequence of the circumferential taper of the bricks, said additional gap width also decreases from the inside of the lining to the outside and is 0 (zero) at height h', so that from h' to the outside the gap width has a constant value S2. However, it is also very readily conceivable that the circumferential taper extends over the entire height of the brick (a part of the height then has to be read as the entire height). In the latter case an angle of 0.25° to 0.45°, for example 0.35°, can be taken for the circumferential taper, the gap width then being preferably between 1 mm and 2.4 mm, for example between 1.2 and 2.0 mm.

The consequence of said additional tapers, that is to say the additional axial tapers and the circumferential tapers, is, therefore, that, in the assembled state, the gap width of the joins S1 and S2 between the bricks is increased to T1 and T2 respectively at the fire side or inside of the wear lining.

In addition, reference numerals 12 and 13 indicate a protrusion and a groove in the side faces 5 and 6. By this means the bricks are able to engage in one another by means of a so-called "tongue and groove" system. This appreciably simplifies the positioning of the bricks, as a result of which the speed at which the bricks are laid can also be increased. A known problem in the case of wear linings for this type of furnace is that the stability of the brickwork decreases as the brickwork becomes increasingly worn. This can be counteracted by the use of bricks having a "tongue and groove" system, which system is advantageously arranged at the part of the brick without additional taper (i.e. between line h' and the outside of the lining), preferably near the outside of the lining.

An increase in the gap width between adjoining bricks can also be produced by providing only one of the adjoining side faces of two bricks located alongside one another with an additional taper. In this case, therefore, only one of the faces of the pairs of faces 5–6 and, respectively, 7–8 is provided with a sloping face section 10 and, respectively, 11. With this arrangement, the "tongue and groove" system ensures that the bricks can be installed only in the correct position with respect to one another.

Figure 2:
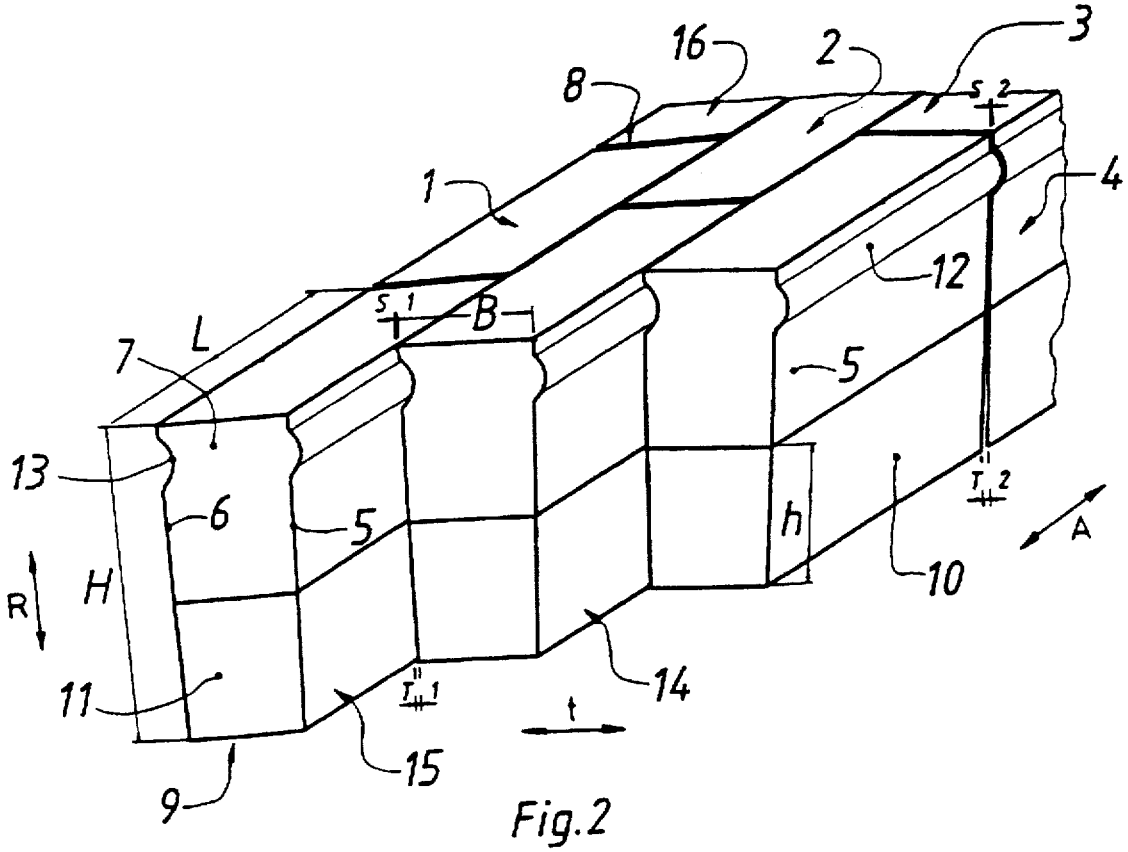
FIG. 2 shows a corresponding part of the wear lining according to another construction.

FIG. 2 shows an embodiment of the wear lining in which bonded brickwork is used. Compared with the situation in FIG. 1, brick 2 is offset backwards by half a brick length L in the axial direction. Furthermore, the bricks 14, 15 and 16 are shown, which further illustrate the bond in the brickwork. In other respects, the bricks have the same shape as those in FIG. 1 and the joins S1, S2, T1 and T2 also have the same dimensions. Depending on the specific application of the wear lining, it can be important, inter alia with a view to the stability of the construction, to give preference to the embodiment according to FIG. 1 or to the embodiment according to FIG. 2.

It is also conceivable to lay the bricks in a bonded arrangement by offsetting them with respect to one another in the circumferential direction instead of in the axial direction. In this case the rings according to FIG. 1 are, as it were, turned with respect to one another.

A list of dimensions has not been given in this description of the figures. This is because, from case to case, the dimensions are highly dependent on the dimensions of the rotary furnace, the nature of the load and the prescribed mode of operation. Nevertheless, it has been found that the application of the characteristics of this invention can lead to an appreciable prolongation of the life of the wear lining under very different conditions.

Sampling has shown that bricks having the following specifications lead to particularly favourable stress distributions:

Brick 1: height/width ratio (H/B) 1 to 3.5; an additional taper of 0.15 to 0.6 times the main taper over a height h of 0.1 H to 0.6 H; increase in the gap width in the cold-assembled state 1 to 2.4 mm.

Brick 2: height/width ratio (H/B) 1.5 to 3.0; additional axial taper of 0.2 to 0.5 times the main taper over a height h of 0.25 H to 0.55 H.

Brick 3: brick having the specifications of Brick 1 or Brick 2 and the following additional specifications: length/height ratio (L/H) 0.45 to 1; a circumferential taper of 0.75 to 1 degree over a height h; and in the cold-assembled state of the wear lining, an increase in the gap width on the inside of 1 to 2.4 mm.

Brick 4: brick according to Brick 3 having a length/height ratio of 0.5 to 0.95 and an increase in the gap width of 1.2 to 2.0 mm.

Without application of the invention it has been found that, during heating up after assembly of the wear lining, the stress distribution over the height of the bricks is highly irregular, with high stress peaks on the inside of the wear lining and in particular in the vicinity of the rings for rotation. Said stress peaks can give rise to damage, each point of damage constituting a location where increased chemical attack can take effect. It has been found that with an appropriate choice of brick material, for example corundum, and of the shaping of the bricks according to the invention, the stress distribution in the bricks is more uniform and that there is appreciably less mechanical damage and local chemical attack. As a consequence, the life of the wear lining is appreciably prolonged. Comparative calculations show that, with comparable dimensioning, the average internal peak stress on the inside of the wear lining can be reduced from about 50 MPa to about 15 MPa.

We claim:

1. Wear lining for a rotary furnace of an incineration installation for chemical waste, wherein the wear lining comprises tapered bricks which are installed in the furnace in the form of a vaulted lining, the main taper of each brick being matched to the desired vaulted lining shape, and wherein the height of the bricks extends in the thickness direction of the lining, in which the bricks have an additional taper which extends at least over part of the height thereof, which additional taper provides, on the inside of the lining, an increase in the gap width between adjoining bricks which decreases towards the outside of the lining, characterised in that the increased gap widths between the bricks are filled with mortar and that the bricks are of the type having a high corundum content, which type contains at least 70% aluminium oxide and also contains oxides of one or more of the following elements: silicon, titanium, zirconium, sodium, chromium, magnesium and phosphorus.

2. Wear lining according to claim 1, characterised in that the additional taper amounts to 0.15 to 0.6 times the main taper.

3. Wear lining according to claim 1, characterised in that the additional taper extends over 0.1 to 0.6 times the height of the brick.

4. Wear lining according to claim 1, characterised in that in the cold assembled state, the increase in the gap width on the inside of the lining is in the range from 1 mm to 2.4 mm.

5. Wear lining according to claim 1, characterised in that the bricks have a porosity of less than 18%.

6. Wear lining according to claim 1, characterised in that the at least one additional taper is a circumferential taper.

7. Wear lining according to claim 6, characterised in that the circumferential taper is 0.75 to 1 degree.

8. Wear lining according to claim 1 characterised in that the height/width ratio of a brick is in the range from 1 to 3.5.

9. Wear lining according to claim 1 characterised in that the length/height ratio of a brick is in the range from 0.45 to 1.3.

10. Wear lining according to claim 1 characterised in that only one of the adjoining side faces of two bricks located alongside one another is provided with an additional taper.

11. Wear lining according to claim 1 characterised in that adjoining bricks engage in one another in the vicinity of the outside of the lining by means of a tongue and groove system.

* * * * *